US010578043B2

(12) United States Patent
Hirchenhein et al.

(10) Patent No.: US 10,578,043 B2
(45) Date of Patent: Mar. 3, 2020

(54) METHOD FOR RECOGNIZING A STATE OF CHANGE OF A FUEL INJECTOR

(71) Applicant: Robert Bosch GmbH, Stuttgart (DE)

(72) Inventors: Achim Hirchenhein, Bietigheim-Bissingen (DE); Alexander Schenck Zu Schweinsberg, Moeglingen (DE); Klaus Joos, Walheim (DE)

(73) Assignee: Robert Bosch GmbH, Stuttgart (DE)

( * ) Notice: Subject to any disclaimer, the term of this patent is extended or adjusted under 35 U.S.C. 154(b) by 33 days.

(21) Appl. No.: 15/748,061

(22) PCT Filed: Jul. 7, 2016

(86) PCT No.: PCT/EP2016/066075
§ 371 (c)(1),
(2) Date: Jan. 26, 2018

(87) PCT Pub. No.: WO2017/021091
PCT Pub. Date: Feb. 9, 2017

(65) Prior Publication Data

US 2018/0223761 A1 Aug. 9, 2018

(30) Foreign Application Priority Data

Aug. 4, 2015 (DE) ..... 10 2015 214 817

(51) Int. Cl.
*F02D 41/22* (2006.01)
*F02D 41/38* (2006.01)
(Continued)

(52) U.S. Cl.
CPC ..... *F02D 41/221* (2013.01); *F02D 41/3809* (2013.01); *F02M 65/00* (2013.01);
(Continued)

(58) Field of Classification Search
CPC ..... F02D 41/22; F02D 41/221; F02D 41/38; F02D 41/3809; F02M 65/00
(Continued)

(56) References Cited

U.S. PATENT DOCUMENTS 5,299,550 A 4/1994 Inoue
5,445,019 A 8/1995 Glidewell et al.
(Continued)

FOREIGN PATENT DOCUMENTS

DE 102007028900 A1 12/2008
DE 102010029837 A1 12/2011
(Continued)

OTHER PUBLICATIONS

International Search Report dated Oct. 17, 2016, of the corresponding International Application PCT/EP2016/066075 filed Jul. 7, 2016.

*Primary Examiner* — John Kwon
*Assistant Examiner* — Johnny H Hoang
(74) *Attorney, Agent, or Firm* — Norton Rose Fulbright US LLP; Gerard Messina

(57) ABSTRACT

A method for recognizing a state change of a fuel injector of an internal combustion engine, in which fuel from a high-pressure accumulator is injected into a combustion chamber with the aid of the fuel injector. A value that is representative of a static flow rate of fuel through the fuel injector is ascertained. A state change of the fuel injector is deduced when the representative value differs from a comparative value by more than a first threshold value.

19 Claims, 3 Drawing Sheets

(51) Int. Cl.
*F02M 65/00* (2006.01)
*F02D 41/24* (2006.01)

(52) U.S. Cl.
CPC .... *F02D 41/2467* (2013.01); *F02D 2041/224* (2013.01); *F02D 2041/228* (2013.01); *F02D 2041/389* (2013.01); *F02D 2200/0614* (2013.01); *F02M 2200/06* (2013.01); *F02M 2200/247* (2013.01)

(58) Field of Classification Search
USPC ..... 123/445, 447, 495–501; 701/102–104
See application file for complete search history.

(56) References Cited

U.S. PATENT DOCUMENTS 8,897,996 B2 * 11/2014 Massaro ..... F02D 41/222 123/198 D
9,097,245 B2 * 8/2015 Knoblauch-Xander ..... F02D 41/221
9,267,460 B2 * 2/2016 Carey ..... F02D 41/22
9,903,306 B2 * 2/2018 Carey ..... F02D 41/3845
10,184,414 B2 * 1/2019 Laviola ..... F02D 41/0087
10,260,446 B2 * 4/2019 Ottikkutti ..... F02D 41/3845
2003/0226399 A1 * 12/2003 Clingerman ..... H01M 8/04186 73/114.53
2008/0059039 A1 * 3/2008 Nakagawa ..... F02D 41/2464 701/99
2010/0163000 A1 7/2010 Futonagane et al.
2011/0030655 A1 * 2/2011 Kaneko ..... F02D 41/22 123/456
2011/0315117 A1 * 12/2011 Gerstner ..... F02M 55/004 123/447
2012/0150417 A1 6/2012 Massaro
2014/0331962 A1 * 11/2014 Stockner ..... F02D 19/0623 123/304
2014/0360470 A1 * 12/2014 Breuille-Martin .... F02D 41/221 123/456
2015/0112576 A1 * 4/2015 Watanabe ..... F02D 41/1401 701/104
2015/0361904 A1 * 12/2015 Mano ..... F02D 15/02 123/48 A
2018/0038328 A1 * 2/2018 Louven ..... F02M 43/02

FOREIGN PATENT DOCUMENTS

DE 102015205877 A1 10/2016
JP 2008309081 A 12/2008

* cited by examiner

METHOD FOR RECOGNIZING A STATE OF CHANGE OF A FUEL INJECTOR

FIELD

The present invention relates to a method for recognizing a state change of a fuel injector, a processing unit, and a computer program for carrying out the method.

BACKGROUND INFORMATION

Motor vehicles are sometimes subject to very stringent pollutant emission limits. In order to meet current and in particular also future emission or exhaust limits, accurate fuel metering during injection, among other factors, is very important.

However, it must be taken into account that various tolerances are present during the metering. Such metering tolerances generally result from sample-based needle dynamics and the sample-based static flow rate of the fuel injectors. An influence by the needle dynamics may be reduced, for example, by a mechatronic approach such as so-called controlled valve operation. In controlled valve operation, activation times of the fuel injectors are adapted in the sense of a regulation, for example over the service life of a motor vehicle.

Possible errors in the static flow rate result from tolerances in the injection hole geometry and the needle lift. The injection hole geometry is often optimized for good emission values, although this may increase the sensitivity to carbonization. Thus far, it has usually been possible to correct such errors only globally, i.e., with regard to all fuel injectors of the internal combustion engine together, based on lambda control or mixture adaptation, for example. However, it cannot then be recognized whether individual fuel injectors of the internal combustion engine have a deviation with regard to their static flow rate (i.e., the fuel injectors deliver different quantities for the same opening duration), which may be relevant to exhaust emissions or smooth running.

A method is described in, for example, German Patent Application No. DE 10 2015 205 877 for ascertaining a static flow rate of a fuel injector or a value that is representative of same.

SUMMARY

A method for recognizing a state change of a fuel injector, a processing unit, and a computer program for carrying out the method, are provided according to the present invention. Advantageous example embodiments and refinements are described.

An example method according to the present invention is used for recognizing a state change of a fuel injector of an internal combustion engine, in which fuel from a high-pressure accumulator is injected into a combustion chamber with the aid of the fuel injector. A value that is representative of a static flow rate of fuel through the fuel injector is ascertained. A state change (generally, a functional impairment) of the fuel injector is deduced when the representative value deviates from a comparative value by more than a first threshold value. Depending on the type and the extent of the change, a response may be made to the driver via an error correction measure and/or an error memory entry and/or a warning (for example, by activating the malfunction indicator light (MIL)).

The present invention makes use of a targeted recognition of a deviation of the static flow rate of fuel through a fuel injector from a comparative value, as the result of which a drift of the static flow rate, i.e., a gradual deviation from the comparative value, may be deduced, which in turn is an indication of a state change of the fuel injector. Since a state change generally results in a smaller quantity of injected fuel, a slight pressure drop occurs in the high-pressure accumulator, which thus means a downward deviation from the comparative value. It is understood that such a method may be carried out for each fuel injector of an internal combustion engine in the same way.

A functional limitation of the fuel injector is preferably deduced as a state change when a comparative value, for which at least one additional fuel injector of the internal combustion engine is taken into account, is used as the comparative value. A comparison between the fuel injector in question and one or multiple, in particular all other, fuel injectors of the internal combustion engine is thus possible, as the result of which a functional limitation may be deduced very easily, since in particular a change in the static flow rate with respect to the other fuel injectors may be ascertained. It may generally be assumed that the functioning of the fuel injector in question is limited when the representative value of one fuel injector deviates from that of multiple other fuel injectors.

A defect that has been present since the fuel injector began operation is advantageously deduced as a functional limitation when the representative value deviates from the comparative value without a preceding adaptation of the flow rate of the fuel injector. Thus, if a fuel injector has a deviation from the start which is above a certain threshold value, it may be assumed that this fuel injector was defective from the start. A defective fuel injector may thus be recognized very easily. In this case, the fuel injector in question may be replaced, for example.

A defect during operation of the fuel injector is preferably deduced as a functional limitation when the representative value deviates from the comparative value after an adaptation of the flow rate of the fuel injector has previously been carried out. Thus, if a fuel injector has already been adapted once because, for example, a deviation was previously determined, and a deviation that is above a certain threshold value is now recognized once more, it may be assumed that this fuel injector, although initially functional, has become defective during operation. A defective fuel injector may thus be recognized very easily. In this case, the fuel injector in question may be replaced, for example. It is pointed out that the quality of the fuel injector may also be assessed due to the possibility of distinguishing between a defect from the start and a defect that does not appear until during operation.

Carbonization is advantageously deduced as a functional limitation when the representative value deviates from the comparative value after multiple adaptations of the flow rate of the fuel injector, in each case in the same direction, have previously been carried out. Thus, for example, the representative value of the fuel injector may continually drift away in the same direction, even after numerous adaptations or readaptations. If a deviation from the comparative value by a certain threshold value is now determined despite these readaptations, it may be assumed that contamination in the form of carbonization is present. A carbonized fuel injector may thus be recognized very easily. In this case, the fuel injector in question may be cleaned, for example. However, it is possible to also clean all other fuel injectors, for example, as a preventive measure. However, if a deviation is still present after one or multiple cleaning operations, it may be assumed or deduced that the fuel injector is defective, for example due to a manufacturing defect. In this case, the fuel injector in question may be replaced, for example.

It is advantageous when the comparative value is ascertained, in particular as an average value, taking into account appropriate representative values of all, or all other, fuel injectors of the internal combustion engine. A particularly effective comparison with the other fuel injectors is thus possible. In particular, the actual flow rate does not need to be ascertained in this procedure, since only the particular representative values are used which are sufficient for a relative comparison, i.e., the ascertainment of whether the flow rate for one fuel injector possibly deviates from that of the other fuel injectors. In particular, any systematic measuring errors are thus negligible. However, when the conversion values for converting the representative value into the associated flow rate are known, it is also conceivable to directly use the flow rate as representative values. The conversion values include, for example, sufficiently accurate information about the type of fuel, in particular the ethanol content, a fuel temperature, and a pressure in the high-pressure accumulator, the so-called rail pressure. In particular, use may be made of the fact that a deviation in the flow rate or the representative value is generally different for each fuel injector.

A replacement of the fuel injector that has occurred is preferably deduced as a state change when a representative value of the fuel injector that was previously ascertained is used as the comparative value. The state change includes in particular a state change between two successive driving cycles. The comparative value here may have been ascertained in a previous driving cycle. Thus, when a sudden or marked change in the flow rate from one driving cycle to the next is determined, it is very easy to recognize that a replacement of the fuel injector has taken place. Correspondingly, for example an adaptation of the fuel injector, which is then recognized as new, may take place.

A piece of information concerning the state change is advantageously stored when the representative value deviates from the comparative value by more than the first threshold value. For example, 10% of the comparative value may be used here as the first threshold value. When such a deviation occurs, a functional limitation is generally not yet critical to safety, but should be eliminated during the next visit to the repair shop. In this regard, storing the information may include an entry in an error memory. A simple instruction for replacing the fuel injector is thus possible.

A warning to a driver of a motor vehicle, which includes the internal combustion engine, preferably takes place when the representative value deviates from the comparative value by more than a second threshold value that is larger than the first threshold value. For example, 25% of the comparative value may be used here as the second threshold value. When such a deviation occurs, a functional limitation is possibly already critical to safety, and a visit to the repair shop, or at least a low-load driving mode, should be carried out as soon as possible. In this regard, the warning may include, for example, a warning light (MIL, for example) and/or a notification in a display in the motor vehicle. It is thus possible to easily avoid a safety-critical situation.

The comparative value is advantageously repeatedly or continuously updated. The most up-to-date status concerning the indication of a state change may thus always be taken into account. In particular, repeated or continuous monitoring of the fuel injectors may take place in this way.

It is advantageous when a curve of the deviation of the representative value from the comparative value is detected and stored over the service life of the internal combustion engine.

The storage may take place, for example, on a memory in an executing control unit. The data may thus be provided very easily for a repair shop. In particular, for example an easier and more targeted replacement of a defective fuel injector is thus possible. In addition, these field data may be stored and evaluated later, for example.

The representative value is advantageously determined by ascertaining, for at least one injection operation of the fuel injector, a ratio of a pressure difference that occurs in the high-pressure accumulator due to the injection operation, to an associated time period that is characteristic for the injection operation. Use may be made of the fact that the fuel quantity, i.e., its volume, delivered by a fuel injector during an injection operation, is proportional or at least sufficiently proportional to the associated pressure difference, i.e., the difference in pressure before and after the injection operation, in the high-pressure accumulator. When, in addition, a time period that is characteristic for the injection operation is known, a value may be ascertained from the ratio of this pressure difference to the associated time period which, except for a proportionality factor, corresponds to the static flow rate through the fuel injector. A value that is representative of the flow rate may thus be obtained very easily.

A processing unit according to the present invention, for example a control unit, in particular an engine control unit, of a motor vehicle, is configured, in particular by programming, for carrying out a method according to the present invention.

In addition, implementation of the method in the form of a computer program is advantageous, since this entails particularly low costs, in particular when an executing control unit is also utilized for other tasks and is therefore present anyway. Suitable data media for providing the computer program are in particular magnetic, optical, and electrical memories such as hard disks, flash memories, EEPROMs, DVDs, and others. Downloading a program via computer networks (Internet, Intranet, etc.) is also possible.

Further advantages and embodiments of the present invention are described herein and are shown in the figures.

The present invention is schematically illustrated in the figures based on exemplary embodiments, and is described below with reference to the figures.

DETAILED DESCRIPTION OF EXAMPLE EMBODIMENTS

Figure 1:
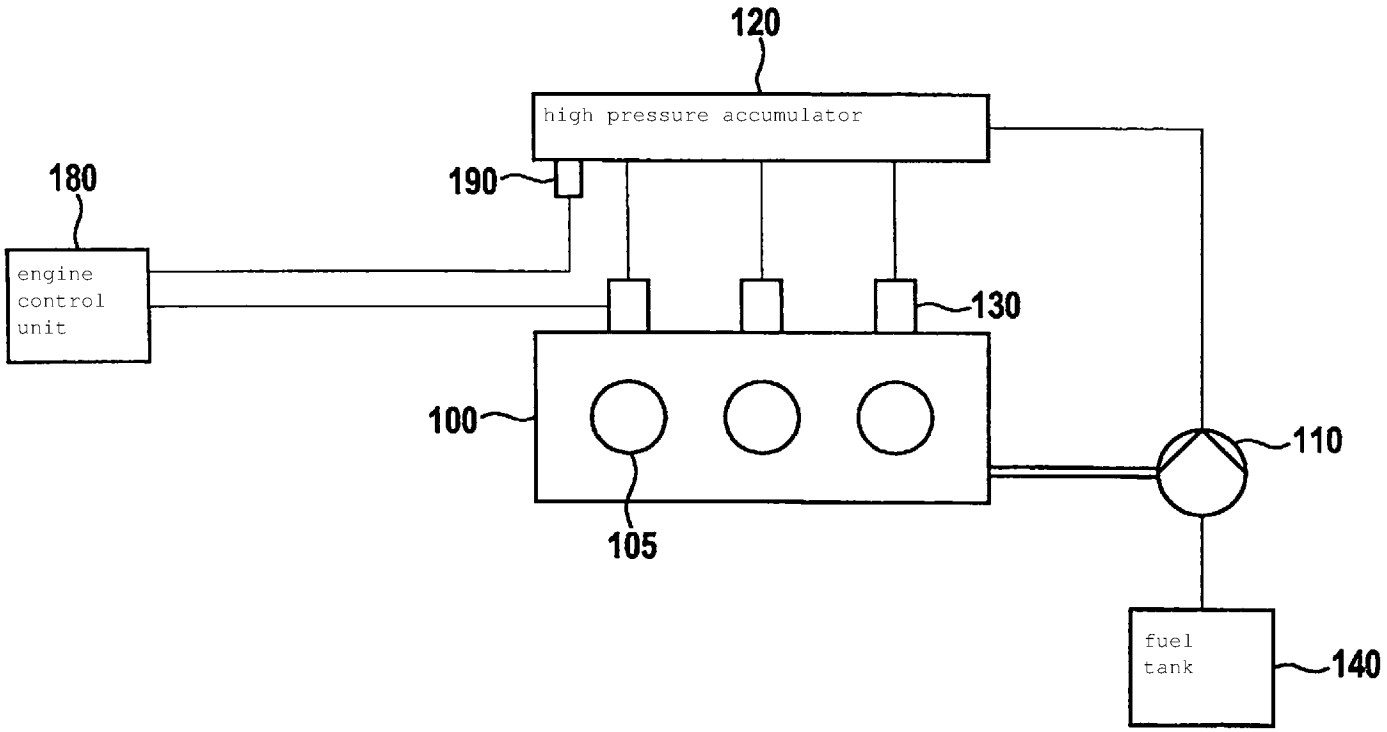
FIG. 1 schematically shows an internal combustion engine including a common rail system, which is suitable for carrying out a method according to the present invention.

FIG. 1 schematically shows an internal combustion engine 100 that is suitable for carrying out a method according to the present invention. As an example, internal combustion engine 100 includes three combustion chambers or associated cylinders 105. Associated with each combustion chamber 105 is a fuel injector 130 which in turn is connected in each case to a high-pressure accumulator 120, a so-called rail, via which the fuel injector is supplied with fuel. It is understood that a method according to the present invention may also be carried out for an internal combustion engine that includes any other given number of cylinders, for example four, six, eight, or twelve cylinders.

In addition, high-pressure accumulator 120 is fed with fuel from a fuel tank 140 via a high-pressure pump 110. High-pressure pump 110 is coupled to internal combustion engine 100, in particular in such a way that the high-pressure pump is driven via a crankshaft of the internal combustion engine or via a camshaft that is in turn coupled to the crankshaft.

Control of fuel injectors 130 for metering fuel into the particular combustion chambers 105 takes place via a processing unit designed as an engine control unit 180. For the sake of clarity, only the connection from engine control unit 180 to one fuel injector 130 is illustrated, although it is understood that each fuel injector 130 is similarly connected to the engine control unit. Each fuel injector 130 may be specifically controlled. In addition, engine control unit 130 is configured for detecting the fuel pressure in high-pressure accumulator 120 with the aid of a pressure sensor 190.

Figure 2:
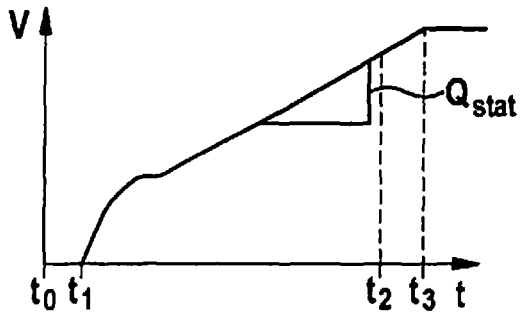
FIG. 2 shows a diagram of a flow volume for a fuel injector as a function of time.

FIG. 2 illustrates a diagram of cumulative flow volume V through a fuel injector as a function of time t for a prolonged control of the fuel injector. A control period begins at point in time $t_0$, and the valve needle begins to lift at point in time $t_1$. An open period of the fuel injector thus also begins at point in time $t_1$. It is apparent that cumulative flow volume V and the quantity of fuel that has flowed through the fuel injector constantly increase over a wide range after a brief period during the lifting of the valve needle. In this range, the valve needle is in so-called full lift; i.e., the valve needle is lifted completely or up to a setpoint height.

During this time, a constant fuel quantity per unit time flows through the valve opening in the fuel injector; i.e., static flow rate $Q_{stat}$, which indicates the slope of cumulative flow volume V, is constant. The magnitude of the static flow rate is an important factor which, as mentioned at the outset, determines the overall fuel quantity that is injected during an injection operation. Deviations or tolerances in the static flow rate therefore affect the injected fuel quantity per injection operation.

The control period ends at point in time $t_3$ and the closing time begins, during which the valve needle begins to drop. The closing time and the open period end at point in time $t_4$, when the valve needle once again completely closes the valve.

Figure 3:
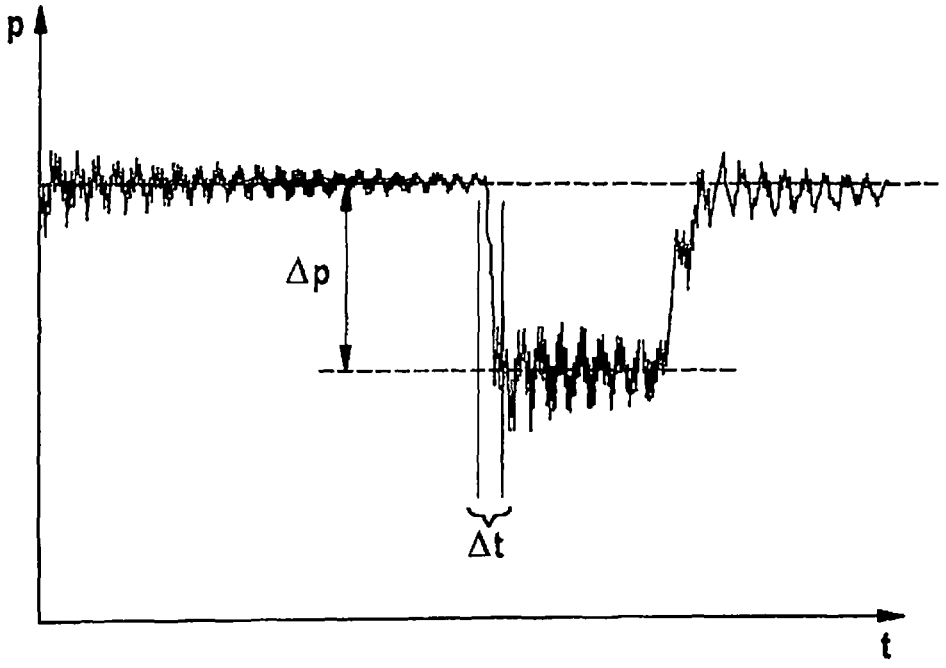
FIG. 3 shows a diagram of a pressure curve in a high-pressure accumulator during an injection operation.

FIG. 3 illustrates a diagram of a pressure curve in a high-pressure accumulator during an injection operation, as a function of time t. It is apparent that pressure p in the high-pressure accumulator, except for certain fluctuations due to pump conveyance and fuel withdrawals due to injections, is essentially constant. During the injection operation, which lasts for a period Δt, pressure p in the high-pressure accumulator drops by a value Δp.

Pressure p, once again except for certain fluctuations, subsequently remains at the lower level until p once again rises to the starting level due to extra conveyance by the high-pressure pump.

The detection and evaluation of these pressure drops during injection operations take place with components that are generally present anyway, such as pressure sensor 190 and engine control unit 180, including corresponding input circuitry. Additional components are therefore not necessary. This evaluation takes place individually for each combustion chamber 105.

As mentioned above, static flow rate $Q_{stat}$ through the fuel injector is characterized by the injected fuel quantity or its volume per unit time. In a high-pressure accumulator or rail that is pumped to system pressure, the injected volume is proportional to the pressure drop in the rail. The associated period corresponds to the open period of the fuel injector, which, as mentioned above, may be determined mechatronically with the aid of a so-called controlled valve operation (see German Patent Application No. DE 10 2009 002 593 A1, for example).

By forming the quotient of the pressure drop or pressure difference Δp and the open period, i.e., period of injection Δt, a pressure rate is obtained as a substitute value or representative value $R_{stat}=\Delta p/\Delta t$ for static flow rate $Q_{stat}$; i.e., for a measuring operation, $Q_{stat}$:

$$\frac{\Delta p}{\Delta t}$$

applies. Extra conveyance by the high-pressure pump should not fall into the relevant time window, and therefore may possibly need to be suppressed.

Figure 4:
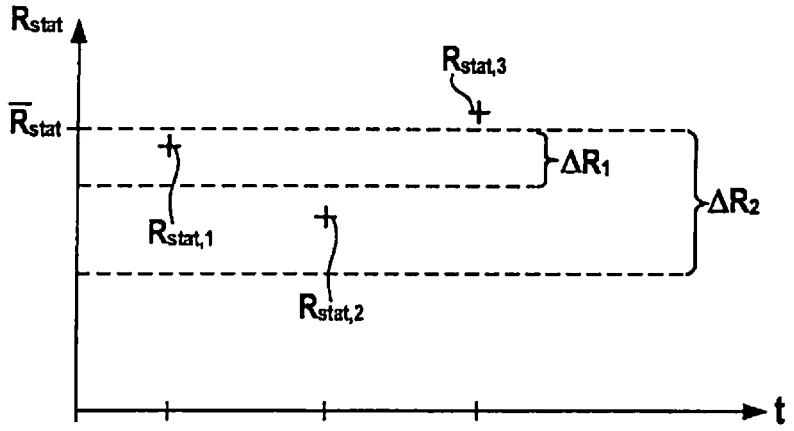
FIG. 4 shows a representative value of a static flow rate and a comparative value in a method according to the present invention in one preferred specific embodiment.

FIG. 4 shows a diagram by way of example of three representative values $R_{stat,1}$, $R_{stat,2}$, and $R_{stat,3}$ which may be ascertained, for example, for the fuel injectors shown in FIG. 1 according to the method described above.

Also shown is a comparative value $\overline{R}_{stat}$ which may be obtained, for example, from the two representative values $R_{stat,1}$ and $R_{stat,3}$, for example, as the arithmetic mean. The comparative value is thus ascertained from all fuel injectors except for the fuel injector being examined. However, it is also conceivable to ascertain the threshold value from all three fuel injectors (or all fuel injectors present), i.e., including the examined fuel injector, in which case the threshold values may need to be defined differently. However, recognizing a deviation is generally easier in the variant shown.

A first threshold value $\Delta R_1$ and a second threshold value $\Delta R_2$ are also shown. As is apparent in FIG. 4, representative value $R_{stat,2}$ deviates from comparative value $\overline{R}_{stat}$ by more than first threshold value $\Delta R_1$, but by less than second threshold value $\Delta R_2$. In this case a defect of the fuel injector in question may be deduced, and the information concerning the defect may be stored in an error memory, for example. The injector should be replaced at the earliest opportunity.

If during a subsequent check, for example, representative value $R_{stat,2}$ deviates from comparative value $\overline{R}_{stat}$ by more than second threshold value $\Delta R_2$, for example, a warning message may be sent to a driver. The injector should be immediately replaced, since the extent of the defect or the functional impairment has become too great for a reliable or low-emission operation.

Figure 5:
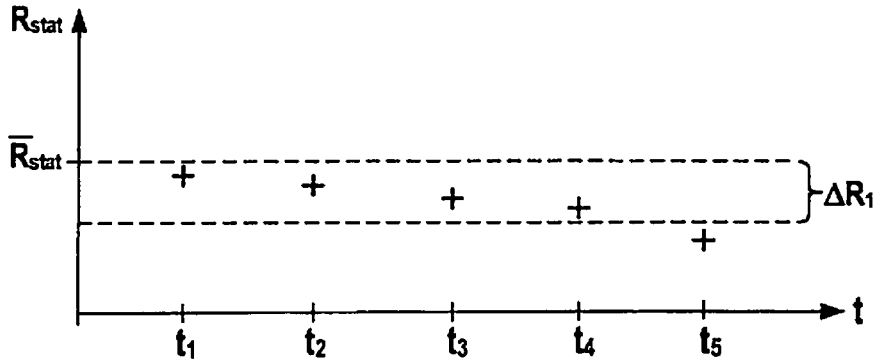
FIG. 5 shows a curve of a representative value of a static flow rate in a method according to the present invention in another preferred specific embodiment.

FIG. 5 illustrates a curve of a representative value of a static flow rate as a function of time t in a method according to the present invention, in another preferred specific embodiment. The representative value shown here may be, for example, representative value $R_{stat,2}$ shown in FIG. 3, which may be ascertained at points in time $t_1$ through $t_5$ in the manner described above. Points in time $t_1$ through $t_5$ in particular come from different driving cycles.

Also shown is comparative value $\overline{R}_{stat}$, which may also be ascertained as described above. It is understood that the comparative value does not necessarily have to remain constant over time, as shown here, and instead may also vary when it is formed as the average value of multiple representative values.

In the curve of the representative value, the deviation from the comparative value becomes increasingly greater. In particular, for example after each ascertainment of a deviation, i.e., at each of points in time $t_1$ through $t_4$, a readaptation, i.e., an adaptation of the static flow rate, may take place.

However, as shown at point in time $t_5$, for example, if a deviation from comparative value $\overline{R}_{stat}$ by more than first threshold value $\Delta R_1$ is now determined, based on the increasing deviation despite readaptations, a carbonized fuel injector is to be assumed. As an error correction measure, an attempt may be made to clean the fuel injector by changing the combustion conditions. Alternatively, or if this is not successful, the information concerning the carbonization may be stored in the error memory. The injector should then be replaced at the earliest opportunity.

Figure 6:
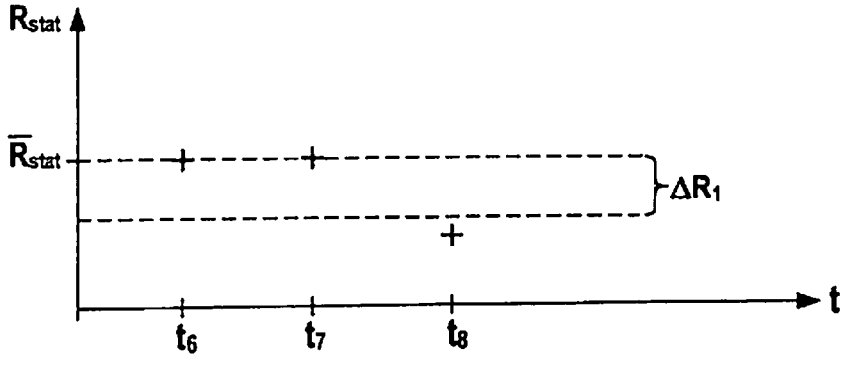
FIG. 6 shows a curve of a representative value of a static flow rate in a method according to the present invention in another preferred specific embodiment.

FIG. 6 illustrates a curve of a representative value of a static flow rate as a function of time t in a method according to the present invention, in another preferred specific embodiment. The representative value shown here may be, for example, representative value $R_{stat,2}$ shown in FIG. 3, which may be ascertained for each point in time $t_6$ through $t_8$ in the manner described above.

Also shown is comparative value $\overline{R}_{stat}$, which here may correspond, for example, to the representative value at point in time $t_7$ or to an average value of the representative values at points in time $t_6$ and $t_7$.

A deviation from comparative value $\overline{R}_{stat}$ by more than first threshold value $\Delta R_1$ is now to be determined at point in time $t_8$.

Since the comparative value is the representative value of the fuel injector at the same position in the internal combustion engine as at point in time $t_8$, it is to be assumed that a different fuel injector is now present. A replacement of a fuel injector may be ascertained in this way.

What is claimed is:

1. A method for recognizing a functional impairment of a fuel injector of an internal combustion engine in a motor vehicle, in which fuel from a high-pressure accumulator is injected into a combustion chamber using the fuel injector, the method comprising:

measuring during a fuel injection by the fuel injector using a pressure sensor, a pressure drop in the high-pressure accumulator;

ascertaining a value that is representative of a static flow rate of fuel through the fuel injector, the representative value being ascertained as a ratio of the measured pressure drop to a time period of the fuel injection;

comparing the representative value to a comparative value, the comparative value being an average of representative values of: (i) all fuel injectors of the internal combustion engine, or (ii) all fuel injectors of the internal combustion engine except the fuel injector, wherein each of the representative values is a ratio of a measured pressure drop during a fuel injection of a respective one of the fuel injectors to a time period of the fuel injection of the respective one of the fuel injectors;

determining functional impairment of the fuel injector when the representative value deviates from the comparative value by greater than a first threshold value; and based on determining the functional impairment, performing at least one of the following: (i) storing information about the functional impairment of the fuel injector in memory, (ii) sending a warning message to a driver of the motor vehicle about the functional impairment of the fuel injector, the sending of the warning message including activating a warning light in the motor vehicle or displaying a notification in the motor vehicle about the functional impairment, (iii) adapting a flow rate of the fuel injector, (iv) performing a cleaning operation of the fuel injector by changing combustion conditions in the internal combustion engine.

2. The method as recited in claim 1, wherein a defect that has been present since the fuel injector began operation is determined as the functional impairment when the representative value deviates from the comparative value without a preceding adaptation of the flow rate of the fuel injector.

3. The method as recited in claim 1, wherein a defect during operation of the fuel injector is determined as the functional impairment when the representative value deviates from the comparative value after a preceding adaptation of the flow rate of the fuel injector.

4. The method as recited in claim 1, wherein carbonization is determined as the functional impairment when the representative value deviates from the comparative value after multiple preceding adaptations of the flow rate of the fuel injector, in each case in the same direction.

5. The method as recited in claim 1, further comprising:

detecting that the fuel injector has been replaced by comparing representative values of the fuel injector ascertained in successive driving cycles, and determining the representative values deviate from each other by more than a threshold value.

6. The method as recited in claim 1, wherein based on determining the functional impairment, the information about the functional impairment is stored in the memory.

7. The method as recited in claim 1, wherein based on determining the functional impairment, the warning message is sent to the driver.

8. The method as recited in claim 1, wherein the comparative value is repeatedly or continuously updated.

9. The method as recited in claim 1, wherein a curve of the deviation of the representative value from the comparative value is detected and stored over a service life of the internal combustion engine.

10. The method as recited in claim 1, wherein the first threshold is 10% of the comparative value.

11. The method as recited in claim 1, wherein the first threshold is 25% of the comparative value.

12. The method as recited in claim 1, wherein based on determining the functional impairment, the flow rate of the fuel injector is adapted.

13. The method as recited in claim 1, wherein based on determining the functional impairment, the cleaning operation of the fuel injector is performed by changing the combustion conditions in the internal combustion engine.

14. A processing unit configured for recognizing a functional impairment of a fuel injector of an internal combustion engine in a motor vehicle, in which fuel from a high-pressure accumulator is injected into a combustion chamber using the fuel injector, the processing unit configured to:

measuring during a fuel injection by the fuel injector using a pressure sensor, a pressure drop in the high-pressure accumulator;

ascertain a value that is representative of a static flow rate of fuel through the fuel injector, the representative value being ascertained as a ratio of the measured pressure drop to a time period of the fuel injection;

compare the representative value to a comparative value, the comparative value is an average of representative values of: (i) all fuel injectors of the internal combustion engine, or (ii) all fuel injectors of the internal combustion engine except the fuel injector, wherein each of the representative values is a ratio of a measured pressure drop during a fuel injection of a respective one of the fuel injectors to a time period of the fuel injection of the respective one of the fuel injectors;

determine a functional impairment of the fuel injector when the representative value deviates from the comparative value by greater than a first threshold value; and based on determining the functional impairment, perform at least one of the following: (i) store information about the functional impairment of the fuel injector in memory, (ii) send a warning message to a driver of the motor vehicle about the functional impairment of the fuel injector, the sending of the warning message including activation of a warning light in the motor vehicle or display of a notification in the motor vehicle about the functional impairment, (iii) adapt a flow rate of the fuel injector, (iv) perform a cleaning operation of the fuel injector by changing combustion conditions in the internal combustion engine.

15. The processing unit as recited in claim 14, wherein the first threshold is 10% of the comparative value.

16. The processing unit as recited in claim 14, wherein the first threshold is 25% of the comparative value.

17. A non-transitory machine-readable memory medium on which is stored a computer program for recognizing a functional impairment of a fuel injector of an internal combustion engine in a motor vehicle, in which fuel from a high-pressure accumulator is injected into a combustion chamber using the fuel injector, the computer program, when executed by a processor, causing the processor to perform:

measuring during a fuel injection by the fuel injector using a pressure sensor, a pressure drop in the high-pressure accumulator;

ascertaining a value that is representative of a static flow rate of fuel through the fuel injector, the representative value being ascertained as a ratio of the measured pressure drop to a time period of the fuel injection;

comparing the representative value to a comparative value, the comparative value being an average of representative values of: (i) all fuel injectors of the internal combustion engine, or (ii) all fuel injectors of the internal combustion engine except the fuel injector, wherein each of the representative values is a ratio of a measured pressure drop during a fuel injection of a respective one of the fuel injectors to a time period of the fuel injection of the respective one of the fuel injectors;

determining functional impairment of the fuel injector when the representative value deviates from the comparative value by greater than a first threshold value; and based on determining the functional impairment, performing at least one of the following: (i) storing information about the functional impairment of the fuel injector in memory, (ii) sending a warning message to a driver of the motor vehicle about the functional impairment of the fuel injector, the sending of the warning message including activating a warning light in the motor vehicle or displaying a notification in the motor vehicle about the functional impairment, (iii) adapting a flow rate of the fuel injector, (iv) performing a cleaning operation of the fuel injector by changing combustion conditions in the internal combustion engine.

18. The non-transitory machine-readable memory medium 17, wherein the first threshold is 10% of the comparative value.

19. The non-transitory machine-readable memory medium 17, wherein the first threshold is 25% of the comparative value.

* * * * *